United States Patent [19]

Johnson

[11] Patent Number: 4,597,247

[45] Date of Patent: Jul. 1, 1986

[54] METHOD AND APPARATUS FOR APPLYING CONTROLLED HEAT TO A GROUP OF ARTICLES DISPOSED WITHIN A SHRINK FILM WRAPPER

[75] Inventor: Roy A. Johnson, Marietta, Ga.

[73] Assignee: The Mead Corporation, Dayton, Ohio

[21] Appl. No.: 787,256

[22] Filed: Oct. 15, 1985

[51] Int. Cl.[4] ..... B65B 53/06

[52] U.S. Cl. ..... 53/557; 34/225

[58] Field of Search ..... 53/442, 557; 34/225

[56] References Cited

U.S. PATENT DOCUMENTS

| | | | |
|---|---|---|---|
| 3,120,728 | 2/1964 | Snow | 53/557 X |
| 3,187,441 | 6/1965 | Kamp | 34/225 X |
| 3,222,800 | 12/1965 | Siegel | 53/557 X |
| 3,309,835 | 3/1967 | Peppler | 53/557 X |
| 3,619,910 | 11/1971 | Carmichael | 53/557 X |
| 3,621,588 | 11/1971 | Grocke | 34/225 |
| 3,744,146 | 7/1973 | Nichols | 53/557 X |
| 3,782,070 | 1/1974 | Erlandson | 53/557 |
| 4,014,107 | 3/1977 | Bachrich | 34/225 X |

*Primary Examiner*—John Sipos

*Attorney, Agent, or Firm*—Rodgers & Rodgers

[57] ABSTRACT

For applying heat to groups of articles disposed within a wrapper of shrink film whose ends are overlapped and disposed below the articles, a tunnel is provided including a conveyor through the tunnel having air passages therethrough and on which the groups of articles are disposed while being moved through the tunnel, a heater disposed below the conveyor, a primary fan for driving air through the heater and into a conduit which directs heated air through the passages in the conveyor and directly to the overlapped ends of the wrapper together with a fan and conduit for directing heated air at a lower temperature to the ends and sides of the groups of articles.

11 Claims, 12 Drawing Figures

METHOD AND APPARATUS FOR APPLYING CONTROLLED HEAT TO A GROUP OF ARTICLES DISPOSED WITHIN A SHRINK FILM WRAPPER

TECHNICAL FIELD

This invention relates to a method and apparatus for heating a wrapper of shrink film disposed about a group of articles and with the ends of the wrapper disposed in overlapped relation beneath the group of articles together with means for applying heated air from below to the overlapped ends of the wrapper together with means for supplying air directly to the ends and sides of the packaged articles which is at a lower temperature than the air supplied to the overlapped ends of the wrapper.

BACKGROUND ART

Shrink tunnels for applying heat to shrink film diposed about a group of articles and having overlapped ends disposed below the article group are known. One difficulty which is characteristic of many such systems is due to the fact that shrink film tends to shrink too rapidly and become wrinkled in certain areas and, when so wrinkled, portions of the wrinkled areas become adhered to each other and thus result in an unattractive and possibly insecure container for the packaged articles.

DISCLOSURE OF THE INVENTION

According to this invention in one form, undesired wrinkling action which characterizes many known shrink film systems is avoided by controlled application of heated air to the overlapped bottom portions of a container wrapper together with the simultaneous application of heated air to the ends and sides of the package which is at a lower temperature than the temperature of air supplied to the overlapped bottom portions of the wrapper. By this means the sides and ends of the film are shrunk gradually so as to avoid the sudden wrinkling and resulting undesired adhesion of adjacent parts of the shrink film wrapper to each other and the accompanying unattractive appearance of the package. According to one facet of the invention, air which is supplied to the sides of the package is not reheated but rather is simply made up of return air supplied from the shrink tunnel on a continuous basis, such air being at a temperature below the constantly reheated air which is supplied to the overlapped bottom portions of the shrink film. According to another aspect of the invention means are provided for controlling the quantity of air supplied both to the bottom of the package and to its sides and ends.

BEST MODE OF CARRYING OUT THE INVENTION

The finished packages shown in FIGS. 9–12 include the "bulls eye B.E." at each end and are arranged in transverse relation to the conveyors which transport the packages through the shrink tunnel.

Figure 2:
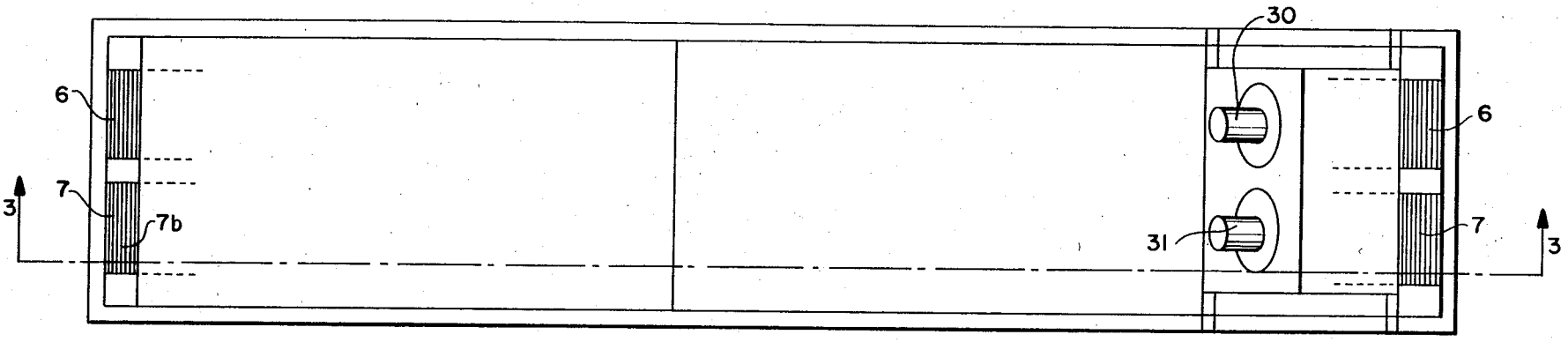
FIG. 2 is a top view from above of the structure shown in FIG. 1.
Figure 1:
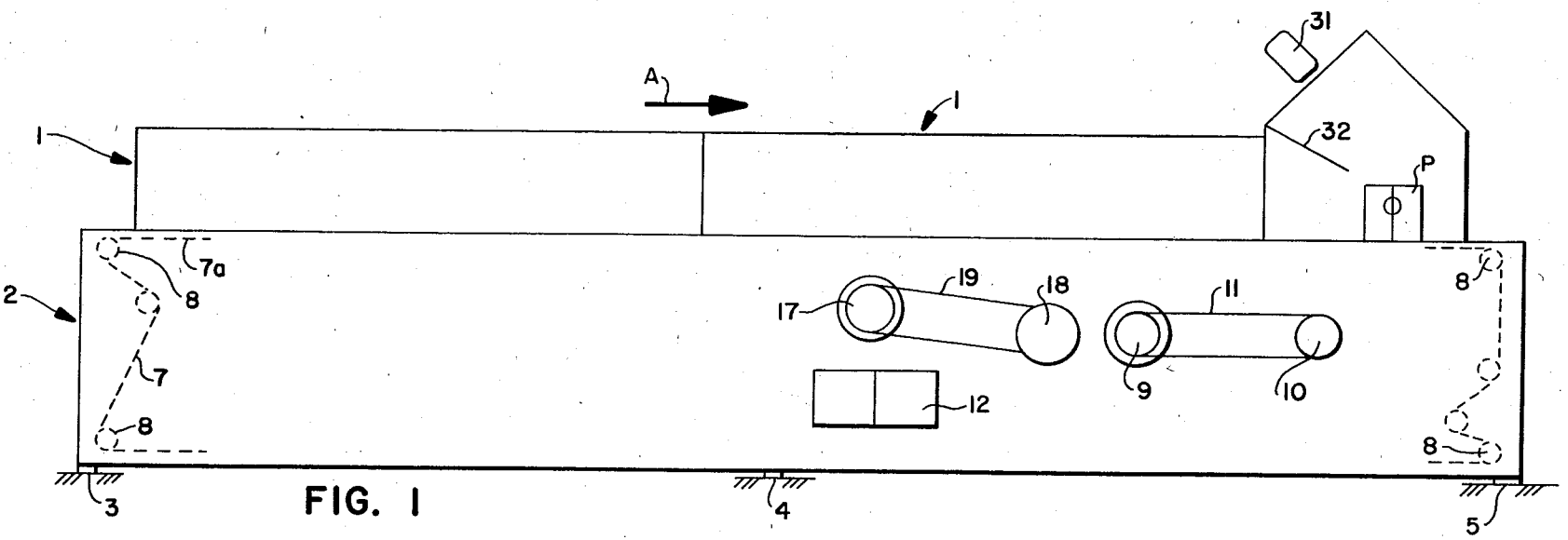
FIG. 1 is a side view of a shrink tunnel formed according to this invention.
Figure 3:
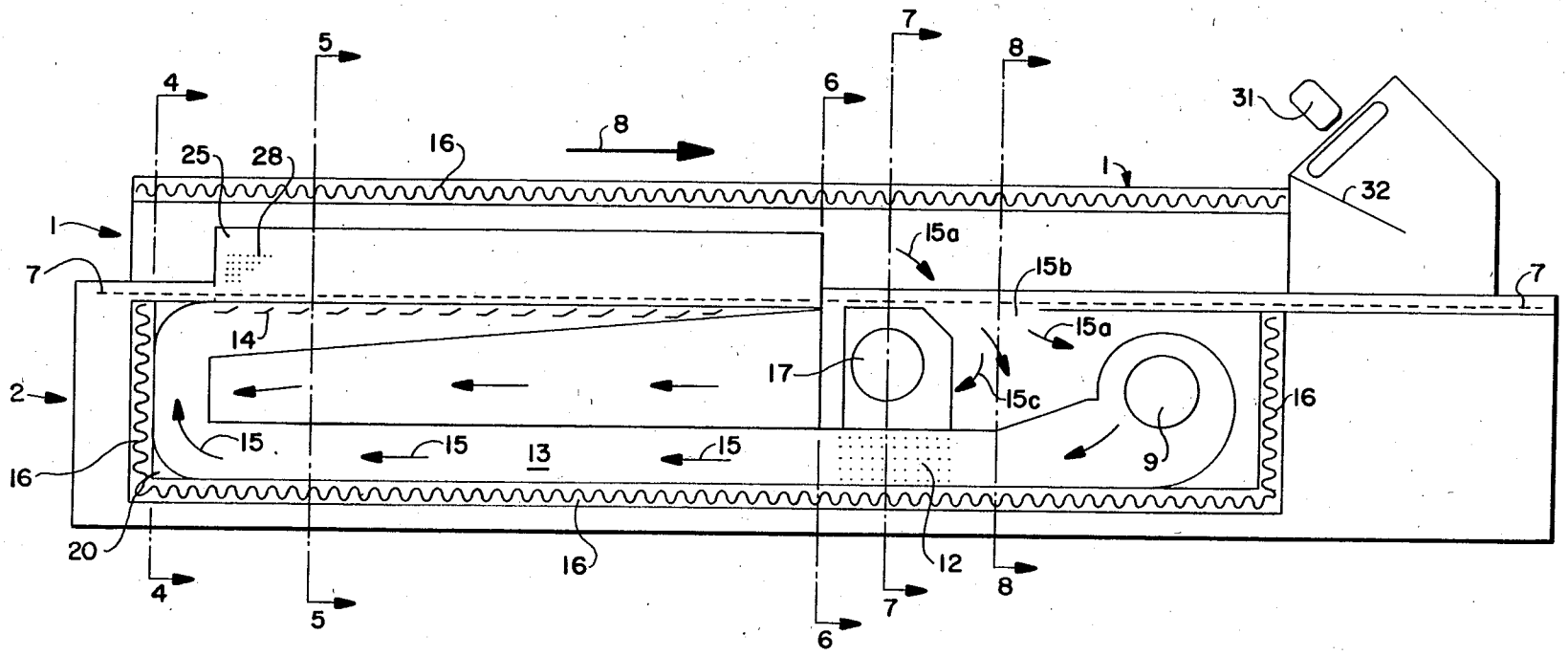
FIG. 3 is a cross sectional view taken along the line designated 3—3 in FIG. 2.
Figure 6:
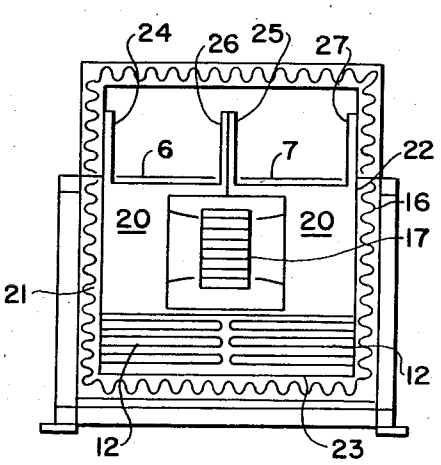
FIGS. 4, 5, 6, 7 and 8 are cross sectional views taken along the lines designated 4—4, 5—5, 6—6, 7—7, and 8—8 in FIG. 3.
Figure 5:
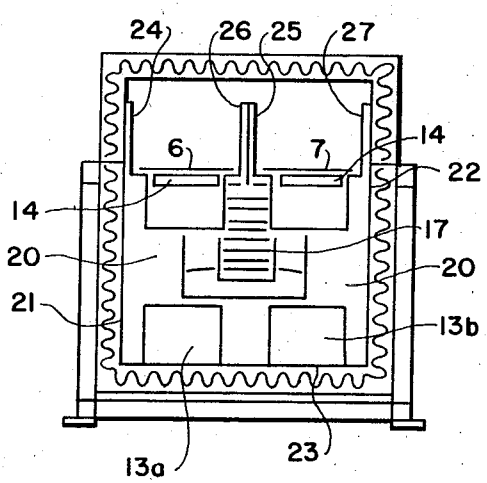

With reference to FIGS. 1, 2 and 3, the numeral 1 generally designates a shrink tunnel which is disposed above and mounted on a housing generally designated by the numeral 2 which is mounted on schematically represented feet 3, 4 and 5.

For conveying two rows of article groups through the tunnel 1, a pair of conveyors 6 and 7 are provided. The top working reach of a conveyor such as is indicated at *7a* moves from left to right as viewed in FIGS. 1, 2 and 3 and as represented by the arrow A. Conveyors 6 and 7 as best shown in FIG. 1 are movable about sprockets 8 and are formed of a plurality of spaced apart cross pieces best shown in FIG. 2 and designated *7b*. These cross pieces are mounted on endless chains and are approximately ¼ inch in diameter and are spaced apart by approximately ⅜ inch so as to allow the passage of air from below upwardly through the conveyor elements and into contact with the bottoms of the packaged items which are being conveyed from left to right on the conveyors 6 and 7. While the speed of the conveyors may be varied, it has been found that for many applications of the invention it is desirable to operate the conveyors at a velocity of approximately 60 feet per minute. Of course conveyors 6 and 7 are identical and discussion will be limited generally to conveyor 7 and associated apparatus.

For supplying heated air from below and upwardly through the spaces between the components *7b* of conveyor 7, a fan 9 is provided which is driven by a motor 10 and a driving belt 11. Output of air from fan 9 is driven through schematically represented heater 12 and through conduit 13 and its branch conduits **13*a* and 13*b* upwardly through the conveyors 6 and 7** to the overlapped bottom panels of the shrink film F disposed about the package group.

While the temperature of air supplied through the conveyors 6 and 7 may vary somewhat, it has been found that a suitable temperature of this air is approximately 350 degrees Fahrenheit. The velocity and pressure of air supplied to the bottom of the package is controllable by simply controlling the speed of rotation of motor 10.

Figure 4:
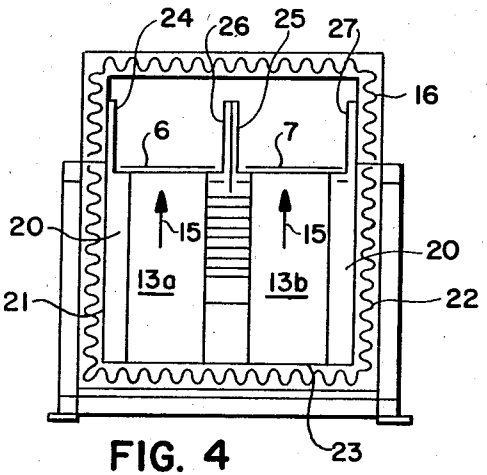
Figure 8:
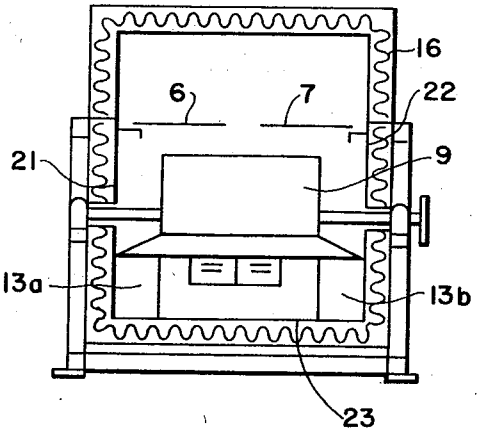
Figure 7:
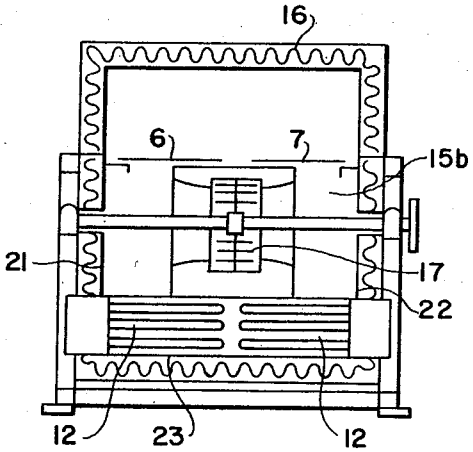
Figure 9:
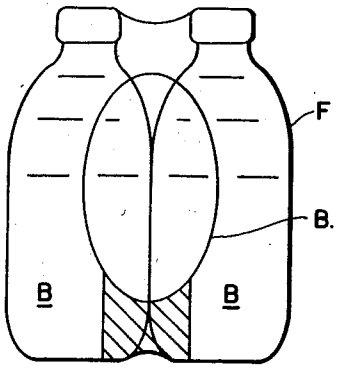
FIG. 9 is an end view of a shrink film package of bottles.
Figure 10:
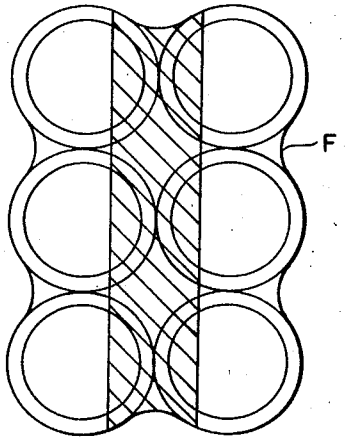
FIG. 10 is a bottom view of the package shown in FIG. 9.
Figure 11:
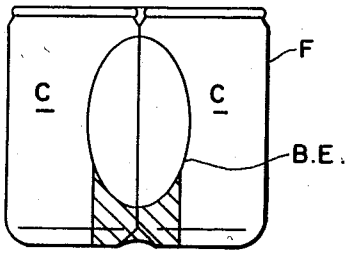
FIG. 11 is an end view of a shrink film package of cans and FIG. 12 is a bottom view of the package shown in FIG. 11.
Figure 12:
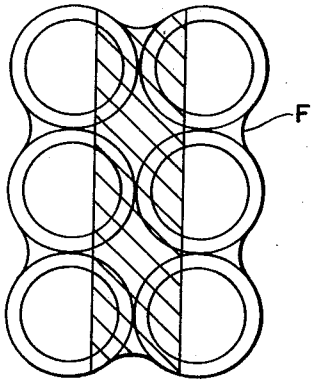

For the purpose of establishing uniform flow of air through the conveyors 6 and 7, a plurality of air diverters best shown schematically in FIG. 3 and designated by the numeral 14 are provided. These diverters are mounted at their ends and are rotatable about their transverse axes to provide suitable adjustment whereby uniformity of flow of air is provided. Adjustment of diverters 14 together with adjustment of the speed of motor 10 and in turn of fan 9 can be used to provide a flow of air through the conveyors 6 and 7 at a discharge velocity in the range between 200 cubic feet per minute and 700 cubic feet per minute. The direction of flow of air in FIGS. 3 and 4 is indicated by means of a plurality of arrows designated by the numeral 15. Return air following the coxpletion of a shrink cycle flows downwardly through conveyor 7 and the opening **15*b* in the top of housing 2 as indicated by arrows 15*a* and into the end of fan 9** for a repeat of the cycle.

For the purpose of isolating the heat tunnel and associated apparatus from the environment, heat insulation generally designated at 16 is provided as best indicated in FIG. 3.

In order to supply heated air to the sides and ends of shrink film packages, a fan 17 is provided and is driven by a motor 18 and a driving belt 19. Fan 17 receives a portion of return air 15*a* as indicated by the arrow 15*c* and drives that air into the plenum chamber 20 disposed about the primary air conduits 13*a* and 13*b* and disposed within the housing having walls 21, 22 and a bottom wall 23 as best shown in FIG. 4. As is shown in FIG. 3, apertured wall 25 includes a plurality of openings 28. These apertures preferably are of diameters in the range between $\frac{1}{4}$ inch to $\frac{5}{8}$ inch. Furthermore, means are provided for closing preselected ones of these apertures to vary the secondary air flow and so as to accommodate packages of different characteristics.

Since the secondary air supplied by fan 17 to plenum chamber 20 is not reheated but simply constitutes return air such as is indicated at 15*c*, which then is directed through the apertures 28 in panel 25 and the corresponding apertures in panels 27, 24 and 26 on opposite sides of the conveyors, the air supplied to the side and end walls of the packages is at a lower temperature than the air supplied to the bottoms of the packages through the conveyors. Preferably the temperature of secondary air supplied to the sides and ends of the packages is approximately 320 degrees Fahrenheit. The pressure of air within the plenum chamber 20 is approximately $1\frac{1}{2}$ inches of water. This pressure may vary somewhat as the number of closures which are used to close the apertures 28 may be changed together with changes in the speed of motor 18 which drives fan 17.

The fact that the air supplied to the sides and ends of the packages is at a lower temperature than the air supplied to the bottom of the packages through conveyors 6 and 7 results in a more gradual heating of the side and end walls of the film F thus causing the shrinkage of the side and end walls to occur more gradually and to do so without undesired wrinkling and adhesion of adjacent wrinkled portions to each other. By this means the integrity and appearance of the package is greatly enhanced according to one principal facet of this invention.

Following completion of the shrinking operation, the packages are passed outwardly toward the right on conveyors 6 and 7 and come under the influence of cooling fans 30 and 31 which with the aid of baffle plate 32 drive atmospheric air downwardly into contact with the package P disposed generally below and to the right of the lower end of baffle 32. This action tends to set the film in its shrinked and finished condition.

This invention is well suited for use in conjunction with shrink film which is of the thickness of one to four mils and wherein the shrink film is low density polyethylene or other similar material and which greatly enhances the appearance and integrity of shrink film packages.

I claim:

1. A shrink tunnel for applying heated air to groups of articles disposed within a wrapper of shrink film whose ends are overlapped and disposed below the articles, said tunnel comprising a conveyor having air passages therethrough on which said groups of articles are disposed in transverse relation therto an which moves through said tunnel, heater means disposed below said conveyor, fan means for driving primary air through said heater means, conduit means for receiving heated primary air from said heater means and for directing heated primary air upwardly through said air passages in said conveyor and directly to the overlapped ends of said wrapper and means for directing said heated primary air at a lower temperature downwardly through said air passages in said conveyor bypassing the heater and thence upwardly and laterally directly to the ends of said groups of articles without reheating said primary air.

2. A shrink tunnel according to claim 1 wherein air directed through said air passages in said conveyor is at a temperature of approximately 350 degrees Fahrenheit.

3. A shrink tunnel according to claim 1 wherein air directed to the ends of said groups of articles is at a temperature of approximately 320 degrees Fahrenheit.

4. A shrink tunnel according to claim 3 wherein discharge chambers are disposed on opposite sides of said tunnel and provided with apertures adjacent the groups of articles for directing heated air to the ends of the articles.

5. A shrink tunnel according to claim 4 wherein said discharge chambers receive air from a common plenum chamber disposed therebelow.

6. A shrink tunnel according to claim 5 wherein return air from the tunnel is suppled by a separate fan means to said plenum.

7. A shrink tunnel according to claim 5 wherein a pair of similar parallel conveyors are movable through said tunnel on each of which groups of articles are disposed and wherein discharge chambers are disposed on opposite sides of each of said conveyors each of which is provided with apertures adjacent the associated conveyor for directing heated air to the ends of the articles.

8. A shrink tunnel according to claim 4 wherein preselected ones of said apertures are closable and wherein said apertures are in the range between $\frac{1}{4}$ inch to $\frac{5}{8}$ inch in diameter.

9. A shrink tunnel according to claim 1 wherein the volume and pressure of said primary and said secondary air are separately controllable.

10. A shrink tunnel according to claim 1 wherein adjustable air diverters are disposed within said conduit means and below said conveyor to establish uniform flow of air along the path of movement to provide a flow of air at a discharge velocity in the range between 200 cubit feet per minute and 700 cubic feet per minute.

11. A shrink tunnel according to claim 3 wherein the pressure of air within said plenum chamber is approximately $1\frac{1}{2}$ inches of water.

* * * * *